US007874864B2

(12) United States Patent
Luu

(10) Patent No.: US 7,874,864 B2
(45) Date of Patent: Jan. 25, 2011

(54) CABLE PLUG WITH FOLDING RETENTION MEMBER

(76) Inventor: Vince Luu, 170 Gemini Ave., Ste. C-11 & C-12, Brea, CA (US) 92821

( * ) Notice: Subject to any disclaimer, the term of this patent is extended or adjusted under 35 U.S.C. 154(b) by 177 days.

(21) Appl. No.: 12/321,633

(22) Filed: Jan. 23, 2009

(65) Prior Publication Data

US 2010/0190371 A1 Jul. 29, 2010

(51) Int. Cl.
*H01R 13/62* (2006.01)

(52) U.S. Cl. ..... 439/373

(58) Field of Classification Search ..... 439/320, 439/373, 359, 345, 372
See application file for complete search history.

(56) References Cited

U.S. PATENT DOCUMENTS 2,399,644 A * 5/1946 Lachance ..... 439/362
4,871,325 A * 10/1989 Maejima et al. ..... 439/353
7,749,015 B2 * 7/2010 Uchikawa et al. ..... 439/362
2009/0280674 A1 * 11/2009 Eppright et al. ..... 439/373

* cited by examiner

*Primary Examiner*—Edwin A. Leon
*Assistant Examiner*—Vanessa Girardi
(74) *Attorney, Agent, or Firm*—Raymond Y. Chan; David and Raymond Patent Firm

(57) ABSTRACT

A cable connector with security arrangement for HDMI cable and the like includes a connector head for being plugged into a terminal socket of an electronic device, and a connector body having at least one retention member pivotally coupling with the connector body for being folded between a folded and unfolded position. The retention member has an attachment slot for aligning with an attachment hole of the terminal socket when the retention member is flipped to the unfolded position so that a fastener can be used to fasten the retention member with the terminal socket so as to securely connect the cable connector with the terminal socket and prevent the cable connector from being accidentally pulled out to disconnect the power or data transmission.

21 Claims, 7 Drawing Sheets

CABLE PLUG WITH FOLDING RETENTION MEMBER

BACKGROUND OF THE PRESENT INVENTION

1. Field of Invention

The present invention relates to a connector for connecting a cable from an electronic device to another electronic device, and more particularly to a cable connector with security arrangement for HDMI cable and the like for linking two devices for power or data transmission.

2. Description of Related Arts

A cable connector is considered as a common component for operatively linking a cable from one electronic device to another electronic device for transmitting a digital signal. The electrical connection between electronic devices such as DVD players, audio and video equipments, electronic game devices, PC monitors, TV displays, and etc. has created a great need of cable connectors capable of transmitting the digital signals or power between the former and the later.

It is common that a multiple kinds of electronic devices are used in a family or an office. Most families have their home entertainment devices, such as television, DVD player, cable box, mass data storage device, and other audio and video equipments, etc., being set up and connected with cable connectors. Various kinds of cable connectors are adapted for connecting the digital signals and the electronic devices. Conventionally, the video and audio signals are transmitted separately by different cables, such as DVI merely for transmitting video signals, and thus a plurality of cables is needed for building the entertainment set. The answer to the clutter of cables was to provide a new cable known as HDMI, high definition multimedia interface, capable of transmitting both audio and video signals.

However, a standard cable connector usually tends to loosen or get disconnected. A standard cable connector usually includes a connector head adapted for coupling with a terminal socket of the electronic device merely by frictions to retain the cable connector within the cable socket of the electronic device. Especially when the cables are tangled and cluttered, it is easy to accidentally unplug the cable connector during the installation or unplugging other cable connectors. Taking the HDMI cable connector for example, although the standard structure of HDMI cable connectors coupling with the cable socket of the electronic device provides some friction to resist unexpected movement of the cable socket, ordinary bumping the connector plugs or associated cables while cleaning, dusting, or moving electronic devices often loosens the cable connector from the proper mating position with typical cable socket of the electronic device.

It not only causes the interruption of the digital signal transmission, but also damages the electronic device by accidentally unplugging the cable connectors. The HDMI connector usually comprises a plurality of contact pins provided inside the connector head and for individually connecting the audio and video cables, wherein the pins may be broken when the connector is accidentally unplugged by the improper direction of pulling the connector. Accordingly, there exists for providing a security arrangement of the cable connector.

To response the loosen cable connector problems, U.S. Pat. No. 7,214,087 B2 suggests a fastening member built-in on the top of the connector body for aligning with an attachment hole of the cable socket of the electronic, in such manner that the connector can detachably coupling with the cable socket of the electronic device by the fastener. However, the fastening member is protruded on top of the cable connector that not only increases the size of the cable connector, but also requires precisely and coaxially aligning the fastening member with the thread hole to lock up the cable connector with the cable socket. However, the manufacturer of the electronic device may not precisely make the thread hole corresponding to the position of the fastening member.

Therefore, the cable connector with the fastening member on the top increases the manufacturing cost and involves relatively more complicated installation. There exists a great need for an improved cable connector to securely coupling with the cable socket, easy installation, and minimized size and manufacturing cost.

SUMMARY OF THE PRESENT INVENTION

The present invention provides a cable connector with security arrangement for HDMI cable and the like, wherein the cable connector is provided for stably coupling the cable connector to a terminal socket of an electronic device to prevent an accidentally unplugging or unwanted movement while no protruding part is required for the cable connector when it is not to use for ease of storage and transportation.

The present invention provides a cable connector with security arrangement for HDMI cable and the like, wherein the cable connector comprises at least one retention member having an attachment slot to lock up with the terminal socket of an electronic device by detachably coupling a fastener with an attachment hole of the terminal socket through the attachment slot.

The present invention provides a cable connector with security arrangement for HDMI cable and the like, wherein the retention member is adapted for being folded at a storage position to minimize the size of the cable connector and unfolded for coupling with the terminal socket of the electronic device.

The present invention provides a cable connector with security arrangement for HDMI cable and the like, wherein the attachment slot of the retention member of the security arrangement has an elongated shape for coupling with the attachment hole of the electronic device for ease of coaxially aligning the fastener, the attachment hole and slot for secure connection that simplifies the operation and installation.

The present invention provides a cable connector with security arrangement for HDMI cable and the like, wherein the cable connector has a simple structure to minimize the manufacturing cost.

Accordingly, in order to accomplish the above objects, the cable connector with security arrangement for connecting a HDMI cable and the like to a device having a socket opening and at least one attachment hole positioned adjacent to the socket opening, wherein the cable connector comprises a connector body and a connector head.

The connector body comprises at least one retention member having a through attachment slot provided thereon, wherein the retention member is pivotally coupled with a peripheral wall of the connector body to pivotally fold between a folded position and an unfolded position, wherein at the folded position, the retention member is folded towards the peripheral wall of the connector body, and at the unfolded position, the retention member is outwardly folded away from the peripheral wall at a stand-up position that the retention member is generally perpendicular to the peripheral wall.

The connector head is frontwardly extended from the connecting end of the connector body for slidably plugging into the socket opening of the terminal socket, in such manner that when the connector head is plugged into the socket opening and the retention member is unfolded at the stand-up position to align the attachment slot with the attachment hole, the connector body is locked up with the terminal socket by detachably coupling a fastener with the attachment hole through the attachment slot.

These and other objectives, features, and advantages of the present invention will become apparent from the following detailed description, the accompanying drawings, and the appended claims.

DETAILED DESCRIPTION OF THE PREFERRED EMBODIMENT

Figure 1:
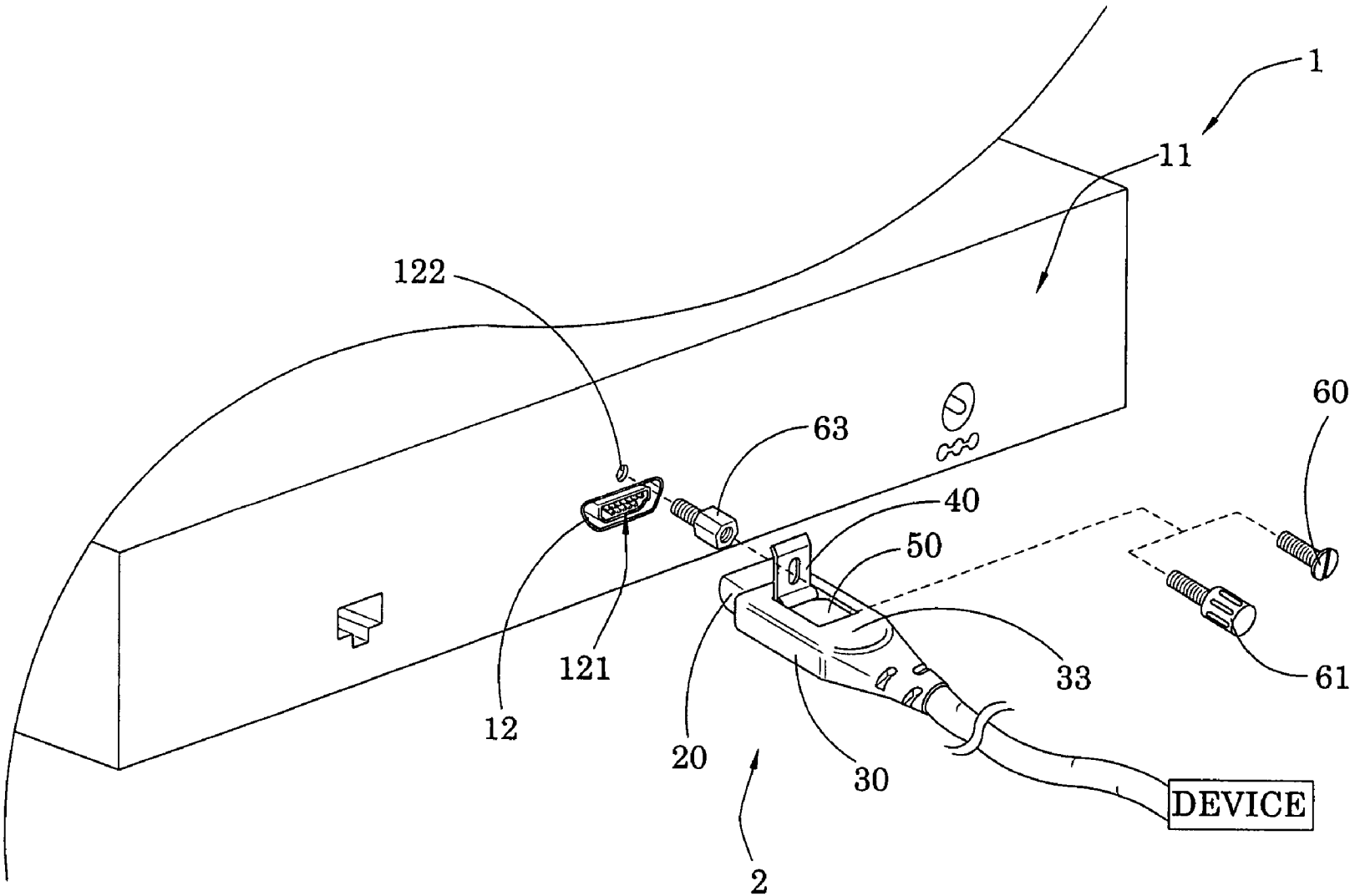
FIG. 1 is a perspective view of a cable connector with security arrangement for HDMI cable and the like according to a preferred embodiment of the present invention, illustrating the cable connector aligning with a terminal socket of an electronic device.

Referring to FIGS. 1 to 7 of the drawings, a cable connector 2 with security arrangement for operatively linking with an electronic device 1 from another device (DEVICE) according to a preferred embodiment of the present invention is illustrated, wherein the cable connector 2 is embodied as a high definition multimedia interface cable connector for connecting a high definition multimedia interface (HDMI) cable to the electronic device 1 having a high definition electronic component. The electronic device 1 comprises a terminal socket 12 having a socket opening 121 located at a rear panel 11 of the electronic device 1 and an attachment hole 122 which is a threaded hole located adjacent to the socket opening 121 and provided for securely fastening the cable connector 2 to the rear panel 11 of the electronic device 1.

Figure 3:
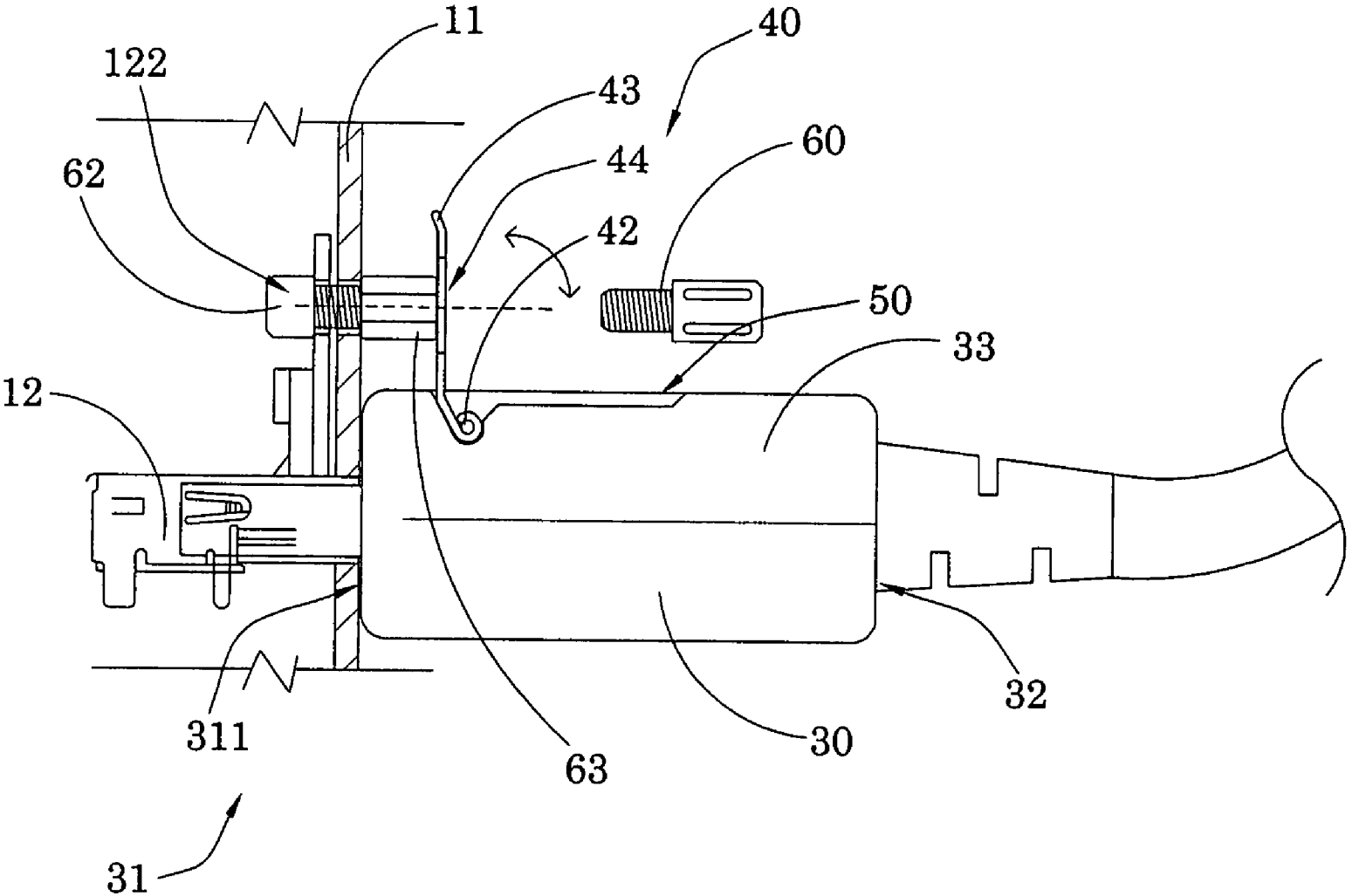
FIG. 3 is an elevation view of the cable connector with security arrangement for HDMI cable and the like according to the above preferred embodiment of the present invention, illustrating the cable connector being plugged into the terminal socket.

The cable connector 2 comprises a connector body 30 having a connecting end 31, a distal end 32, and a peripheral wall 33 extended from the connecting end 31 to the distal end 32, a connector head 20 frontwardly extended from the connecting end 31 of the connector body 30, and a security arrangement comprising a retention member 40 having an attachment slot 44 therein. The connector head 20 has a size and shape for geographically matching fittingly plugged into the socket opening 121 of the electronic device 1 so as to connect the cable connector 2 with the terminal socket 12, as shown in FIG. 3.

The retention member 40 is embodied as a panel made of rigid material such as metal and pivotally connected with the connector body 30 for being flipped to fold between a folded position and an unfolded position.

Figure 2:
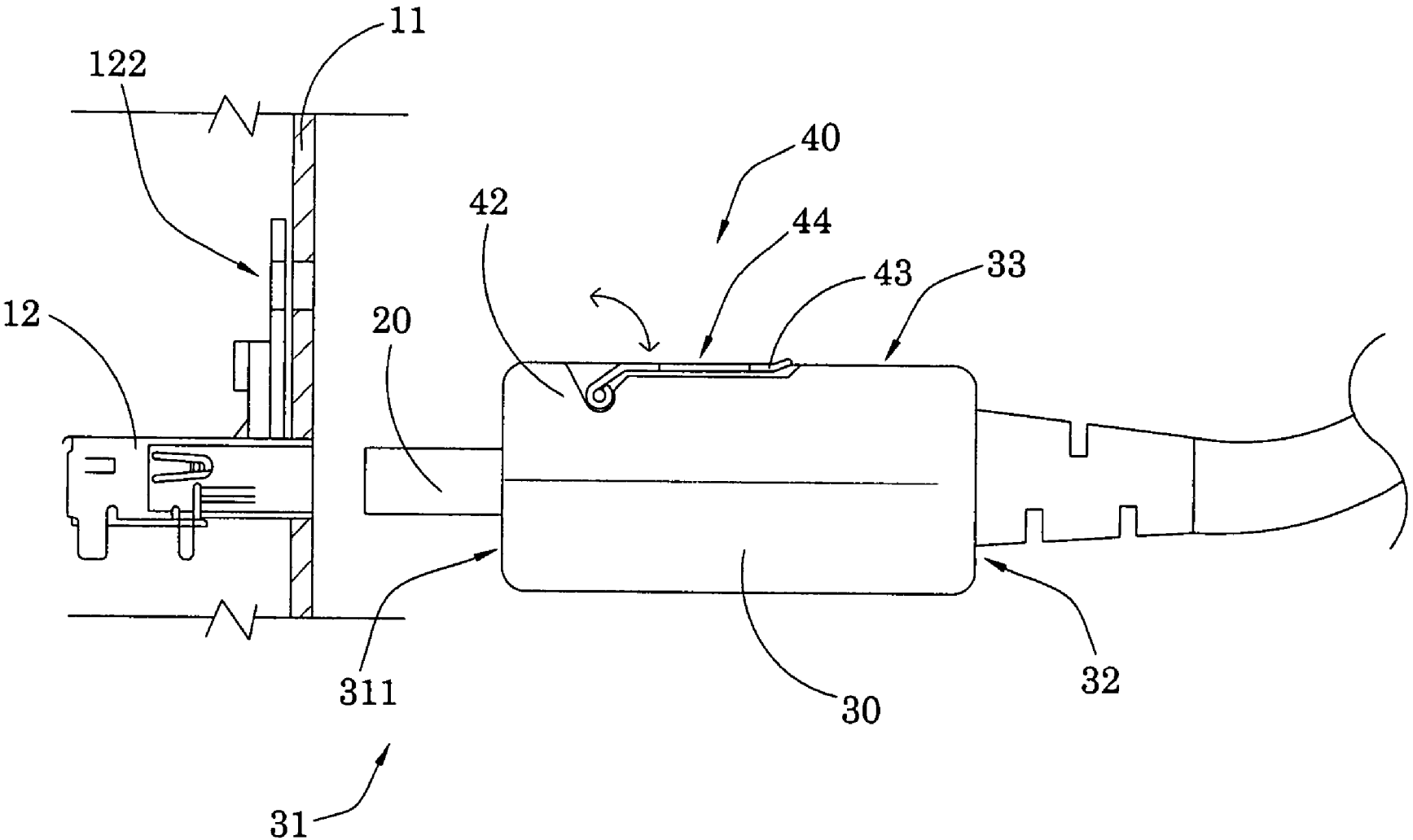
FIG. 2 is an elevation view of the cable connector with security arrangement for HDMI cable and the like according to the above preferred embodiment of the present invention, illustrating the cable connector operatively plugging into the terminal socket.
Figure 4:
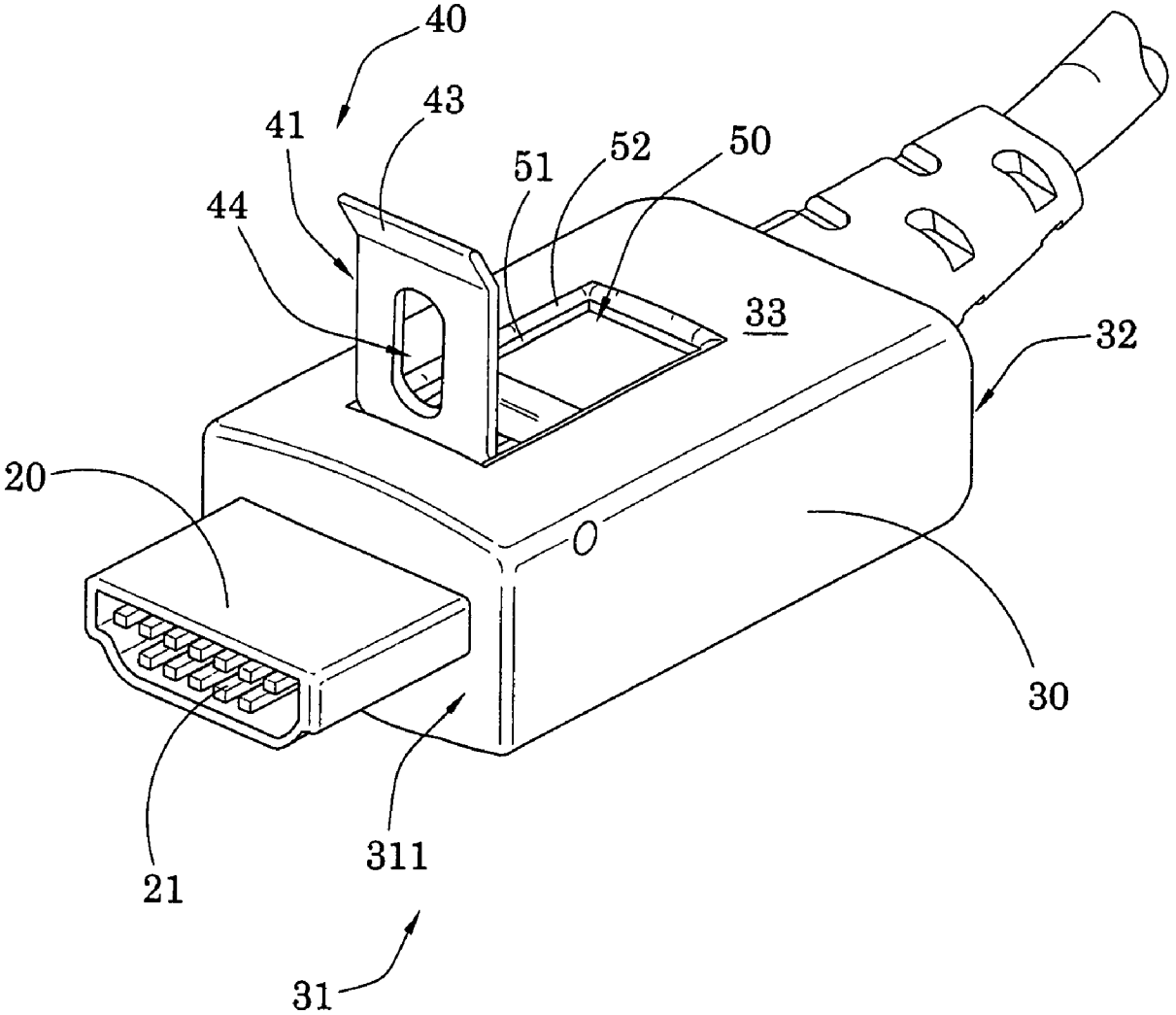
FIG. 4 is a perspective view of the cable connector with security arrangement for HDMI cable and the like according to the above preferred embodiment of the present invention, illustrating the retention member at an unfolded position.
Figure 5:
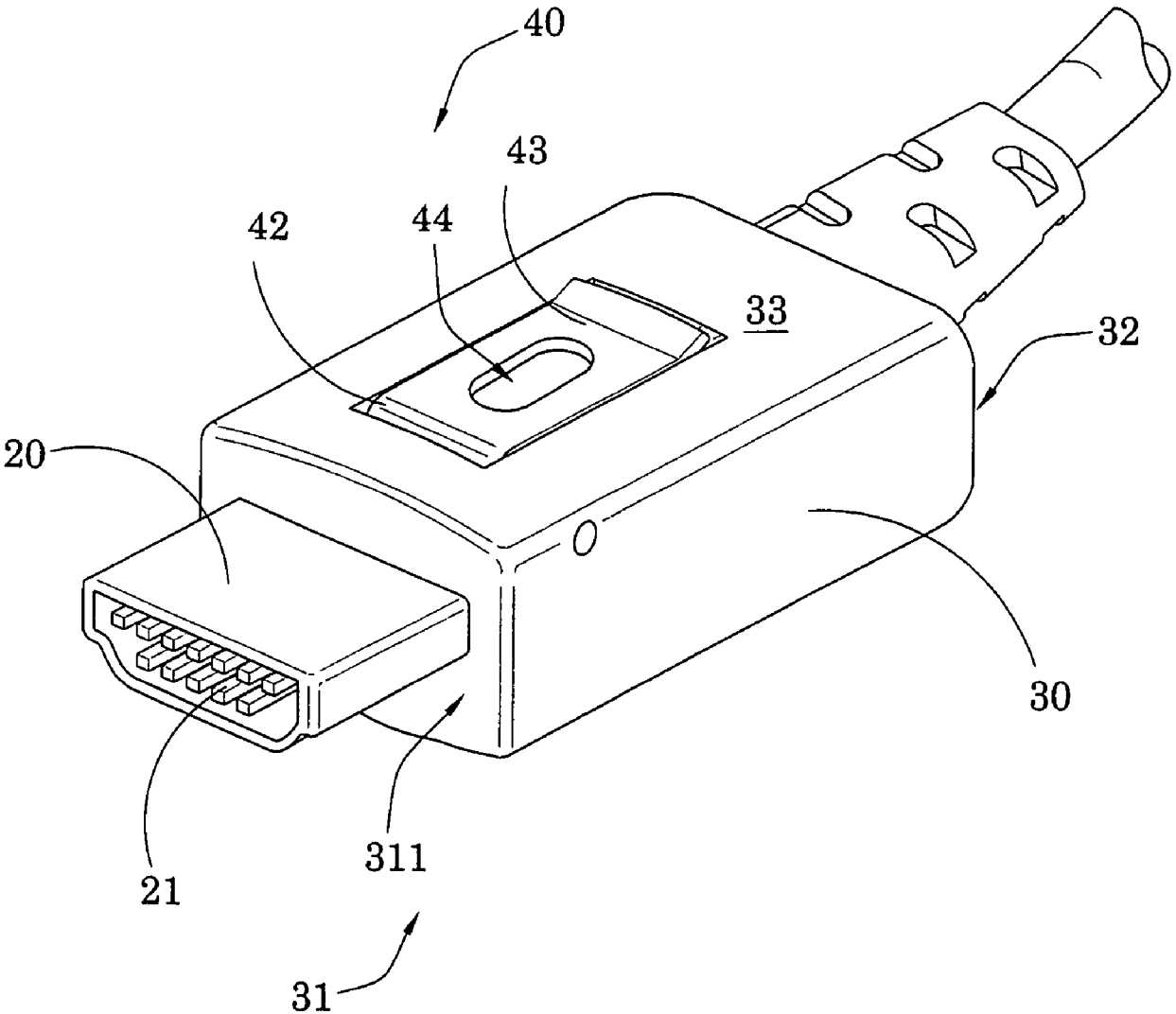
FIG. 5 is a perspective view of with security arrangement for HDMI cable and the like according to the above preferred embodiment of the present invention, illustrating the retention member at a folded position.

As shown in FIGS. 2 and 5, the retention member 40 is constructed to be folded towards the peripheral wall 33 of the connector body 30 at the folded position, wherein the retention member 40 is overlapped with the peripheral wall 33 to prevent any part protruded from the connector body 30. As shown in FIGS. 1, 3 and 4, the retention member 40 is constructed to be unfolded outwardly away from the peripheral wall 33 of the connector body 30 so as to align the attachment slot 44 with the attachment hole 122 of the electronic device 1 when the connector head 20 is plugged into the socket opening 121 of the terminal socket 121, and, therefore, the connector body 30 is locked up with the terminal socket 12 by detachably fastening a fastener 60 with the attachment hole 122 through the attachment slot 44 of the retention member 40.

It is worth mentioning that the fastener 60 can be a screw, a thumbscrew or the like for detachably coupling with the attachment hole 122 of the terminal socket 12 to detachably fasten the connector body 30 with the rear panel of the electronic device 1 so as to fasten the cable connector 2 with the terminal socket 12.

Referring to in FIGS. 1 and 3, according to the preferred embodiment of the present invention, the fastener 60 further comprises a fastening member 63 having at one end a threaded shank and a connection body having a thread hole at the other end, and that a fastener nut 62 is generally affixed to a rear side of rear panel 11 of the electronic device 1 and aligned with the attachment hole 122 to prolong and render the attachment hole a threaded hole such that the threaded shank of the fastening member 63 is able to be screwed into the fastener nut 62 of the attachment hole 122 until the connection body of the fastening member 63 is positioned between the rear panel 11 of the electronic device 1 and the retention member 40.

It is preferably to adjust the position of the fastening member 63 by screwing more or less into the attachment hole 122 to ensure the connection body of the fastening member 63 fittingly supporting between the rear panel 11 of the electronic device 1 and the retention member 40 so as to support the retention member 40 rigidly in its stand-up position and provide a rigid connection between the rear panel 11 and the fastener 60 after the threaded shank of the fastener 60 is screwed into the thread hole of the connection body of the fastening member 63 via the attachment slot 44 of the retention member 40.

In other words, the fastener 60 is detachably and adjustably coupling with the fastening member 63 through the attachment slot 44 in such a manner that the rear panel 12 is sandwiched between the fastener nut 62 and the fastening member 63 and the retention member 40 is sandwiched between the fastening member 63 and the fastener 60. Such that the retention member 40 is detachably and adjustably coupling with the terminal socket 12 through the attachment hole 122.

According to the preferred embodiment of the present invention, the connector body 30 of the cable connector 2 further has a receiving cavity 50 indented in the peripheral wall 33 of the connector body 30 to receive the folded retention member 40. In other words, when the retention member 40 is inwardly folded at the folded position, the retention member 40 is fittingly received in the receiving cavity 50, as shown in FIGS. 2 and 5, and flatly overlapped with the peripheral wall 33, i.e. the bottom surface of the receiving cavity 50, to retain a flat surface for the connector body 30 so as to prevent any protrusion on the connector body 30 and minimize an overall size of the connector body 30 of the cable connector 2. As shown in FIG. 4, the receiving cavity 50 also has two side walls 51 each having a curved retention edge 52 for slidably receiving two side edges 41 of the retention member 40 and for ease of unfolding the retention member 40.

According to the preferred embodiment of the present invention, the retention member 40 further has a tilting edge 43 and a pivot end 42. The pivot end 42 is pivotally coupled with the connector body 30 with a spring effect to retain the retention member 40 in its folded position (i.e. received in the receiving cavity 50) unless a flipping force is applied to uplift the retention member 40 away from the connector body 30 to its unfolded position.

The pivot end 42 is provided at a front wall of receiving cavity 50, so that when the retention member 40 is flipped toward a plugging direction at the unfolded position to detachably coupling with the attachment hole 122 of the terminal socket 12, the retention member 40 is stopped by the front wall of the receiving cavity 50 so as to stably coupling the fastener 60 with the attachment hole 122 through the attachment slot 44 of the retention member 40. The tilting edge 43 is provided at an opposite side of the pivot end 42 having a tilt angle outwardly extended toward the direction of the distal end 32 of the connector body 30, such that the retention member 40 can be easily and pivotally flipped to the unfolded position.

It is appreciated that a distance between two sidewalls 51 of the receiving cavity 50 is slightly wider than a distance between two side edges 41 of the retention member 40. A distance between the front and rear walls of the retention cavity 50 is slightly longer than the distance between the pivot edge 42 and the tilting edge 43 of the retention member 40. A depth of the receiving cavity 50 is slightly deeper than the thickness of the retention member 40.

According to the preferred embodiment of the present invention, since the distance between the top edge of the socket opening 121 and the attachment hole 122 varies for different kinds and models of the electronic device 1, the attachment slot 44 of the retention member 40 is an elongated slot extended between the pivot end 42 and the tilting edge 43 of the retention member 40, wherein the length of the attachment slot 44 is larger than a diameter of the attachment hole 122 of the terminal socket 12 and the width of the attachment slot 44 is equal to or slightly larger than the diameter of the attachment hole 122 of the terminal socket 12, so as to ensure the attachment slot 44 has enough room to align with different positions of the attachment hole 122 of the terminal socket 12 with respect to the fastener 60. Therefore, the same cable connector 2 of the present invention can fit various kinds of electronic device 1 and no accurate and precise coaxial alignment during the manufacturing process is needed for the manufacture of the cable connector 2. It also simplifies the installation of coupling the cable connector 2 to the terminal socket 12 through the attachment slot 44.

The connector body 30 of the cable connector 2 has a rectangular cross section and an enlarged top surface of the peripheral wall 33, wherein the retention member 40 is pivotally coupling on the top surface of the peripheral wall 33 of the connector body 30, so that it is relatively more secure and stable for coupling the cable connector 2 to the terminal socket 12 by coupling the attachment hole 122 with the retention member 40 through the fastener 60.

It is appreciated that the connector head 20 having a pin-type connector further comprises a plurality of connector pins 21 adapted for operatively engaging with the terminal socket 12 through the socket opening 121, wherein the connector pins 21 is connected to an audio cable and an video cable respectively for transmitting both of the audio and video signals to the electronic device 1 through the terminal socket 12 connecting to the connector head 20.

The connecting end 31 of the connector body 30 further forms a biasing surface 311 for contacting with a surrounding surface of the socket opening 121 at the rear panel 11 of the electronic device 1 that the connector head 20 is frontwardly extended therefrom, wherein the biasing surface 311 is adapted for biasing against the surrounding surface of the socket opening 121, i.e. the rear panel 11 of the electronic device 1, so that when the connector head 20 of the cable connector 2 is plugged into the terminal socket 12, the biasing surface 311 is connecting with the surrounding surface of the terminal socket 12 to stop the further forward movement of the connector head 20, so as to ensure the connector head 20 being plugged into the terminal socket 12 through the socket opening 121 to align the attachment hole 122 with the attachment slot 44.

Referring to FIGS. 1, 3, 6, and 7, the fastener 60 can be a thumbscrew 61 which has a fastening portion for being screwed into the attachment hole 122 and a handle portion for applying a torque force by hand to screw the hand screw 61 into the attachment hole 122, so that the thumbscrew 61 is capable of being detachably rotated to lock up the retention member 40 with the attachment hole 122 via the attachment slot 44 without using any tool. Of course, specific tool still may be used to drive the thumbscrew to rotate.

It is apparent that the security arrangement of the cable connector 2 as described above can be incorporated as a DVI cable connector, wherein the DIV cable connector has a head portion and a body portion, wherein two retention members 40 are configured to respectively provide at two side edges of body portion of the DVI cable connector, so that the two retention members 40 are able to be folded between the folded position and the unfolded position to align and couple with two attachment holes of the DVI cable socket of the electronic device through the fasteners 60.

Figure 6:
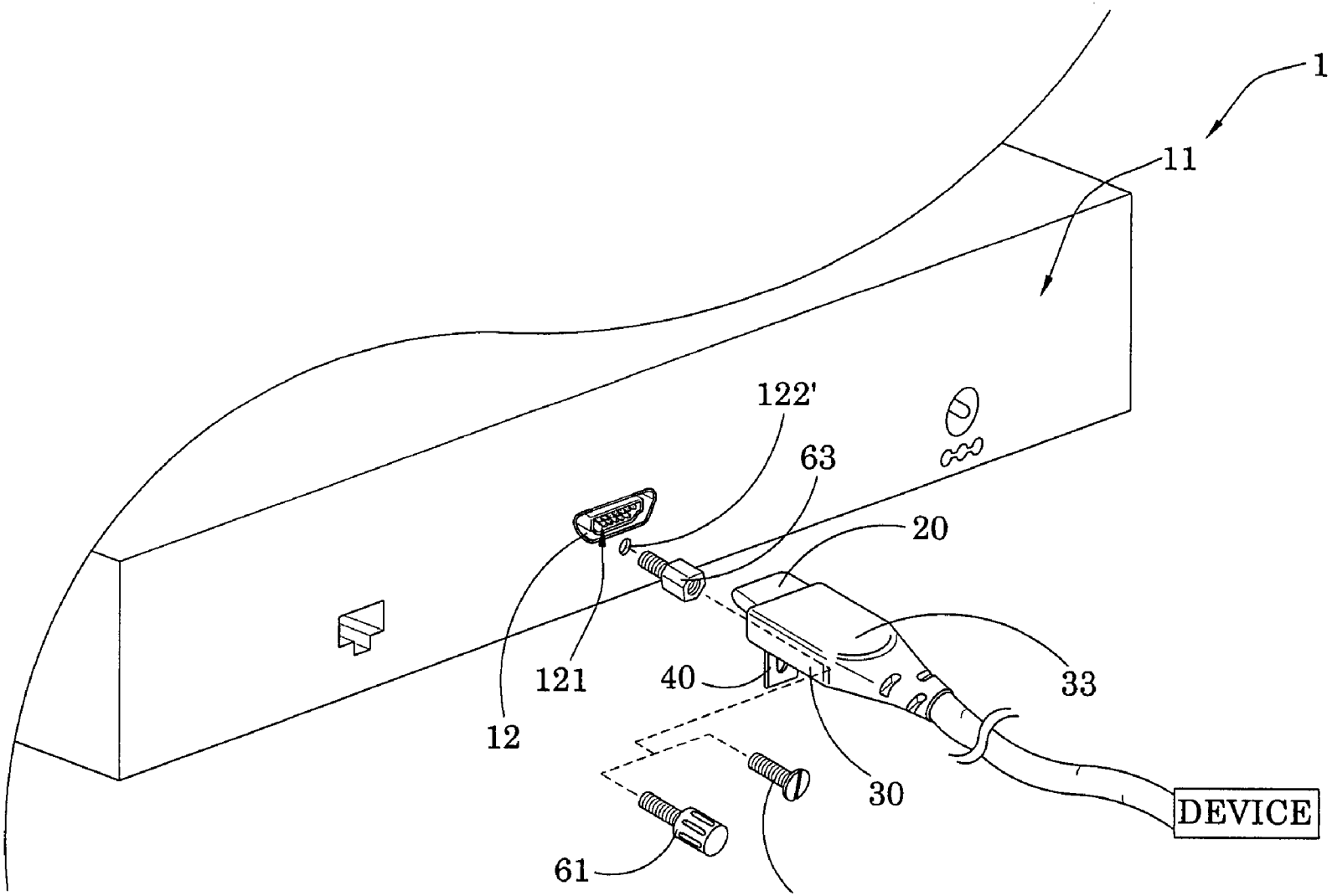
FIG. 6 is a perspective view of a first alternative mode of the cable connector with security arrangement for HDMI cable and the like according to the above preferred embodiment of the present invention.

Referring to FIG. 6 of the drawings, a first alternative mode of the cable connector with security arrangement according to the preferred embodiment of the present invention is illustrated, wherein the retention member 40' is provided at another side of the connector body 30. The retention member 40' also has an attachment slot 44' is pivotally coupling with the connector body for being folded and unfolded, wherein at the folded position, the retention member 40' is folded towards the peripheral wall 33 of the connector body 30, and at the unfolded position, the retention member 40' is outwardly flipped to perpendicular to the peripheral wall 33, in such manner that the attachment hole 122' and the attachment slot 44' are align to couple with the retention member 40' of the cable connector 2 and the terminal socket 12 through the fastener 60 coupling with the fastening member 63.

Figure 7:
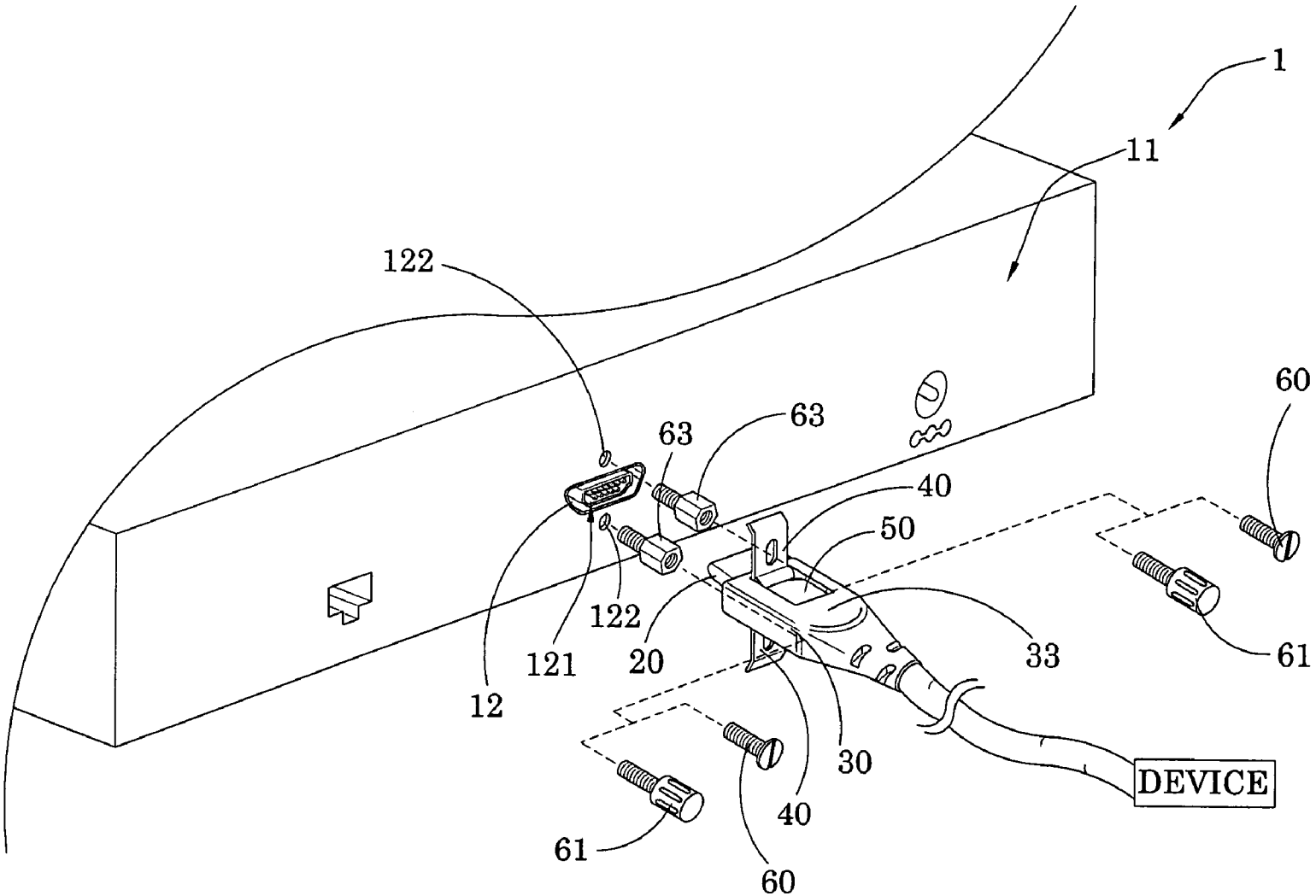
FIG. 7 is a perspective view of a second alternative mode of the cable connector with security arrangement for HDMI cable and the like according to the above preferred embodiment of the present invention.

Referring to FIG. 7 of the drawings, a second alternative mode of the cable connector with security arrangement according to the preferred embodiment of the present invention is illustrated, wherein two retention members 40A, 40B are respectively provided at both the top and bottom sides of the peripheral wall 33 of the connector body 30, wherein each of the retention members 40A has an attachment slot 44A, 44B. Each of the retention members 40A, 40B is pivotally coupling with the connector body 30 for being folded between the folded position and the unfolded position, wherein the retention members 40A, 40B are capable of being folded towards the peripheral wall 33 of the connector body 30 to the folded position, and unfolded outwardly to respectively align the attachment slots 44A, 44B with the attachment holes 122A, 122B of the electronic device 1. Therefore, when the connector head 20 of the cable connector is plugged into the terminal socket 12, the connector body 30 is locked up with the terminal socket 12 by detachably coupling the fastener 60 with the attachment holes 122A, 122B through the attachment slots 44A, 44B of the retention members 40A, 40B.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A cable connector for detachably connecting a HDMI cable or the like to a terminal socket having a socket opening and at least one attachment hole positioned adjacent to the socket opening, wherein said cable connector comprises:

a connecter body having a connecting end, a distal end, and a peripheral wall extended between said connecting end and said distal end;

a connector head frontwardly extended from said connecting end of said connector body for slidably plugging into said socket opening of said terminal socket; and a security arrangement comprising at least a retention member having a through attachment slot provided therein, wherein said retention member is pivotally connected to said connector body and is capable of pivotally folding between a folded position and an unfolded position, wherein at said folded position, said retention member is folded towards said peripheral wall of said connector body, wherein when said connector head is plugged into said socket opening, said retention member is capable of being outwardly unfolded away from said peripheral wall of said connector body to a stand-up position to align said attachment slot with said attachment hole so that said retention member of said connector body is able to be fastened with the terminal socket by detachably coupling a fastener with the attachment hole via said attachment slot.

2. The cable connector, as recited in claim 1, wherein said fastener further comprises a fastening member having a connection body having a thread hole at one end and at the other end a threaded shank for screwing into the attachment hole until said connection body of said fastening member is positioned between the terminal socket and said retention member, wherein said fastener screwed into said thread hole of said connection body of said fastening member via said attachment slot of said retention member so as to fasten said retention member between said fastening member and said fastener for securely fastening said cable connector with said terminal socket.

3. The cable connector, as recited in claim 2, wherein said security arrangement comprises two of said retention members pivotally connected to two opposing sides of said connector body respectively.

4. The cable connector, as recited in claim 1, wherein said retention member has a pivot end pivotally connected with said peripheral wall of said connector body and a tilting edge for ease of pivotally flipping said retention member up from said folded position to said unfolded position.

5. The cable connector, as recited in claim 4, wherein said attachment slot is an elongated slot, extended between said pivot end and said tilting edge, adapted for aligning with the attachment hole to position between two ends of said elongated slot.

6. The cable connector, as recited in claim 4, wherein said security arrangement comprises two of said retention members pivotally connected to two opposing sides of said connector body respectively.

7. The cable connector, as recited in claim 1, wherein said attachment slot is an elongated slot adapted for aligning with the attachment hole to position between two ends of said elongated slot.

8. The cable connector, as recited in claim 7, wherein said fastener further comprises a fastening member having a connection body having a thread hole at one end and at the other end a threaded shank for screwing into the attachment hole until said connection body of said fastening member is positioned between the terminal socket and said retention member, wherein said fastener screwed into said thread hole of said connection body of said fastening member via said attachment slot of said retention member so as to fasten said retention member between said fastening member and said fastener for securely fastening said cable connector with said terminal socket.

9. The cable connector, as recited in claim 7, wherein said security arrangement comprises two of said retention members pivotally connected to two opposing sides of said connector body respectively.

10. The cable connector, as recited in claim 1, wherein said connector body further has a receiving cavity indented in said peripheral wall of said connector body to receive said retention member, wherein when said retention member is pivotally folded towards said peripheral wall to said folded position, said retention member is fittingly received in said receiving cavity and flatly overlapped with said peripheral wall.

11. The cable connector, as recited in claim 10, wherein said connector body has two curved retention edges protruded from two sidewalls of said receiving cavity to slidably engage with two side edges of said retention member so as to retain said retention member within said receiving cavity.

12. The cable connector, as recited in claim 10, wherein said fastener further comprises a fastening member having a connection body having a thread hole at one end and at the other end a threaded shank for screwing into the attachment hole until said connection body of said fastening member is positioned between the terminal socket and said retention member, wherein said fastener screwed into said thread hole of said connection body of said fastening member via said attachment slot of said retention member so as to fasten said retention member between said fastening member and said fastener for securely fastening said cable connector with said terminal socket.

13. The cable connector, as recited in claim 10, wherein said security arrangement comprises two of said retention members pivotally connected to two opposing sides of said connector body respectively.

14. The cable connector, as recited in claim 10, wherein said attachment slot is an elongated slot adapted for aligning with the attachment hole to position between two ends of said elongated slot.

15. The cable connector, as recited in claim 14, wherein said fastener further comprises a fastening member having a connection body having a thread hole at one end and at the other end a threaded shank for screwing into the attachment hole until said connection body of said fastening member is positioned between the terminal socket and said retention member, wherein said fastener screwed into said thread hole of said connection body of said fastening member via said attachment slot of said retention member so as to fasten said retention member between said fastening member and said fastener for securely fastening said cable connector with said terminal socket.

16. The cable connector, as recited in claim 10, wherein said retention member has a pivot end pivotally connected with said peripheral wall of said connector body and a tilting edge for ease of pivotally flipping said retention member up from said folded position to said unfolded position.

17. The cable connector, as recited in claim 16, wherein said connector body has two curved retention edges protruded from two sidewalls of said receiving cavity to slidably engage with two side edges of said retention member so as to retain said retention member within said receiving cavity.

18. The cable connector, as recited in claim 16, wherein said fastener further comprises a fastening member having a connection body having a thread hole at one end and at the other end a threaded shank for screwing into the attachment hole until said connection body of said fastening member is positioned between the terminal socket and said retention member, wherein said fastener screwed into said thread hole of said connection body of said fastening member via said attachment slot of said retention member so as to fasten said retention member between said fastening member and said fastener for securely fastening said cable connector with said terminal socket.

19. The cable connector, as recited in claim 16, wherein said attachment slot is an elongated slot, extended between said pivot end and said tilting edge, adapted for aligning with the attachment hole to position between two ends of said elongated slot.

20. The cable connector, as recited in claim 19, wherein said fastener further comprises a fastening member having a connection body having a thread hole at one end and at the other end a threaded shank for screwing into the attachment hole until said connection body of said fastening member is positioned between the terminal socket and said retention member, wherein said fastener screwed into said thread hole of said connection body of said fastening member via said attachment slot of said retention member so as to fasten said retention member between said fastening member and said fastener for securely fastening said cable connector with said terminal socket.

21. The cable connector, as recited in claim 1, wherein said security arrangement comprises two of said retention members pivotally connected to two opposing sides of said connector body respectively.

* * * * *